US005183954A

United States Patent [19]

Wasser

[11] Patent Number: 5,183,954

[45] Date of Patent: Feb. 2, 1993

[54] CUSHION FOR A TONE HOLE PAD

[75] Inventor: Steven A. Wasser, Wellesley, Mass.

[73] Assignee: Verne O. Powell Flutes, Inc., Waltham, Mass.

[21] Appl. No.: 573,622

[22] Filed: Aug. 27, 1990

[51] Int. Cl.[5] ..... G10F 1/12

[52] U.S. Cl. ..... 84/385 P

[58] Field of Search ..... 84/385 P

[56] References Cited

U.S. PATENT DOCUMENTS 1,604,360 10/1926 McLean ..... 84/385 P
2,540,760 2/1951 Schoemann ..... 84/385 P
3,608,416 9/1971 Nagao ..... 84/385 P
4,158,979 6/1979 Suzuki ..... 84/385 P

FOREIGN PATENT DOCUMENTS 587806 5/1947 United Kingdom ..... 84/385 P

*Primary Examiner*—Michael L. Gellner
*Assistant Examiner*—Howard B. Blankenship
*Attorney, Agent, or Firm*—Iandiorio and Dingman

[57] ABSTRACT

A pad cushion for a pad for closing a tone hole of a musical instrument includes a base member including at least one recess; and a damping medium in the recess for increasing the axial conformability of the pad with the tone holes of the insrument while maintaining the lateral firmness of the pad potion contacting the tone hole.

15 Claims, 3 Drawing Sheets

CUSHION FOR A TONE HOLE PAD

FIELD OF INVENTION

This invention relates to cushion for a pad for closing a tone hole of musical instrument, and more particularly to such a cushion which decouples the ability of the pad to sealingly conform to the tone hole from the ability of the surface of the pad to firmly contact the tone hole. Axial softness or conformability of the cushion is affected while lateral firmness is maintained.

BACKGROUND OF INVENTION

Many wind instruments, especially woodwinds, utilize pads set into cups to cover tone holes in the instrument which, in turn, control the pitch produced by the instrument. Flutes, for example, typically have seventeen pads in cups which cover seventeen tone holes.

Pads can be made of many materials, both natural and synthetic. The most common pad is an assembly comprised of felt backed by cardboard and wrapped in collagen membrane. Cork is also a common material for a natural pad.

Each pad must be installed in its respective cup so that it makes the most complete seal possible in its closed position over the tone hole rim. A great deal of effort can be required to properly align a pad, especially the large sizes, with the tone hole rim over which it is positioned. Smaller pads, such as those found on piccolos, are typically floated into position on a bed of shellac or other adhesive. Good success has been reported floating in pads on a silicon adhesive.

Larger pads are generally not flat enough to be floated into place. For the larger pads highly skilled padders utilize paper or plastic shims of about 0.001" to about 0.020" thick to adjust the alignment of the pad. The addition of a shim behind part or all of the pad has the effect of pushing forward the pad so that it moves closer to the tone hole rim. After shimming the pad, the padder takes a feeler gauge made of a thin material like cigarette paper, inserts the feeler between the pad and the tone hole rim, and closes the pad against the rim. The padder then pulls gently on the feeler to test the tension. Insufficient tension is an indication that the pad is not sealing well in a particular location. The padder repeats this test around the entire rim. If the pad is not covering completely, the key is disassembled from the instrument and reshimmed. A great deal of experience is required to accurately use the feeler and to know just how thick a shim to insert in which location. This shimming process is tedious and can take several days.

Moreover, the natural pads made from felt, collagen and cardboard are subject to change over time and with environmental changes. The membranes are porous and allow moisture to get absorbed by the felt. The membranes contain fibers of different densities which differentially absorb moisture. When the pad absorbs moisture and swells, it does so differentially, causing degradation of the seal between the pad and the tone hole rim.

Pads not only affect how well an instrument plays (related to how good the seal is), but how much "popping noise" is emitted by the instrument action of the pad hitting or slapping against the tone hole rim. Popping noise is undesirable, and the harder the pad material, the more popping noise. A soft pad will produce less noise, but may also feel too "spongy" to the musician, who determines when to stop pushing a key down by the feeling of positive contact that occurs when the pad hits the tone hole rim. A hard or firm pad surface is desirable to give the right feel and sound but such a surface may not conform well to produce the proper sealing between the pad and tone hole. A softer pad improves conformability for better sealing, but typically produces a spongy feel, may take aesthetically undesirable deep impressions from the tone hole rim, and is prone to stick to the tone hole rim.

The inside of a wind instrument is a relatively harsh environment due to corrosive saliva, residual sugars and acids from food eaten, moisture, and rapid temperature changes. This environment attacks the pads and can result in periods of only several months between expensive pad changes. Existing natural pads and some synthetic pads are very difficult to clean once in place as they are not compatible with liquids and solvents.

Great effort has been expended in developing new pads which attempt to address one or more of the above-mentioned problems. Some of these pads still require complicated shimming, such as by selectively bending a metal collar. Others rely on synthetic materials to deform sufficiently to establish a proper seal. Some of these pads are too soft, however, and produce a spongy feel during use. Others are too hard, resulting in excess popping noise and reverberation.

SUMMARY OF INVENTION

It is therefore an object of this invention to provide an improved cushion for a pad for covering a tone hole in a musical instrument.

It is a further object of this invention to provide such an improved cushion which renders the pad easier to align than a natural pad using conventional installation techniques.

It is a further object of this invention to provide such an improved cushion which has advantages of a solid pad, such as easier alignment, while overcoming the hardness deficiency of such relatively rigid pads.

It is a further object of this invention to provide such an improved cushion which has the alignment ease of flat solid synthetic pads without their attendant hardness that causes noise, reverberation and an unforgiving seal.

It is a further object of this invention to provide such an improved cushion which enables the use of pads of organic and synthetic materials, as well as the use of more stable, inert and shape-retaining materials.

It is a further object of this invention to provide such an improved cushion which decouples the axial softness required for good sealing conformity and damping, from the lateral firmness required for ease of installation and non-sticky pad surfaces.

It is a further object of this invention to provide such an improved cushion which enables an expanded range of materials to be used for the pad and the surface of the pad that contacts the tone hole.

It is a further object of this invention to provide such an improved cushion which permits the use of a wide variety of easily and safely cleanable materials for the pad.

It is a further object of this invention to provide such an improved cushion which permits the use of a wide variety of corrosion- and moisture resistant materials in the pad.

It is a further object of this invention to provide such an improved cushion which can be implemented as an independent element or can be made integral with the pad.

This invention results from the realization that a truly improved, effective pad for closing the tone hole of a musical instrument can be achieved by decoupling the ability of the pad to sealingly conform to the tone hole from the ability of the surface of the pad to firmly contact the tone hole using a pad cushion formed either integral with or independent of the pad and including one or more recesses containing a material whose density differs from that of the material surrounding and forming the recesses, thereby providing axial softness required for good sealing conformity and damping, and the lateral firmness required for ease of installation and non-sticky pad surfaces.

This invention features a pad cushion for a pad for closing a tone hole of a musical instrument. There is a base including at least one recess and a damping medium in the recess for increasing the axial conformability of the pad with the tone hole of the instrument while maintaining the lateral firmness of the pad portion contacting the tone hole.

In a preferred embodiment the base member may include a first material having a preselected first density and the damping medium may include a second material having a different density. The second density may be greater or lesser than the first density. The pad cushion may include a number of recesses. The filler medium may be a fluid and the fluid may be air. The base member may include at least one discrete element for defining at least one recess, or it may include a plurality of discrete elements which define a plurality of recesses. The elements may be of two different heights for varying the compressibility of the cushion in stages. The elements of greater height may be more compressible than those of lesser height. The recess may be wholly enclosed in the base member and the medium thereby enclosed may be a liquid such as water or silicone oil. The cushion may be integral with the pad and the base member may be silicone rubber.

The invention also features a pad for closing the tone hole of a musical instrument. There is a pad body including at least one recess. A valving surface of the pad body sealingly contacts the tone hole of an instrument. The damping medium in the recess increases the axial conformability of the pad with the tone hole of the instrument while maintaining the lateral firmness of the pad portion contacting the tone hole.

In a preferred embodiment the base member may include a first material having a preselected first density and the damping medium may include a second material having a different density. The second density may be more or less than the first density. The pad may include a number of recesses. The filler medium may be a fluid such as air or water. The pad body may include at least one discrete element for defining at least one recess or it may include a plurality of discrete elements which define a plurality of recesses. The discrete elements may be of at least two different heights for varying the compressibility of the cushion in stages. The discrete elements of greater height may be more compressible than those of lesser height. The recess or recesses may be totally enclosed in the pad body. The filler medium may be a liquid such as water or silicone oil, and the material of the pad body may be silicone rubber.

DISCLOSURE OF PREFERRED EMBODIMENT

Other objects, features and advantages will occur to those skilled in the art from the following description of a preferred embodiment and the accompanying drawings, in which.

This invention involves a cushion for a pad for closing the tone hole of a musical instrument. The cushion may be separate and independent of a pad but assembled with it in the cup or the cushion may be formed as a integral part of the pad. The cushion, whether a part of the pad or an independent member is formed of a first material having a preselected first density, such as RBC Industries, Inc.'s silicone rubber 7125 with catalyst 720 which has a specific gravity of 1.05. The cushion or cushion portion of the pad is formed so that one or more recesses are created. The cushion may be formed entirely of one material or may be formed of more than one material: studs of one substance (e.g., rubber) could be fixed to a plate of another (e.g., cork). The recess or recesses are filled with a medium for increasing the axial conformability of the pad with the tone hole while maintaining the lateral firmness of the pad portion contacting the tone hole. This medium could be a gas, a liquid, or a solid. If it is a solid the density of the solid should be lower than the density of the pad. Air has a density of 0.0761 lb. per cubic foot, which compares to water at 0.0361 lb. per cubic inch (62.38 lb. per cubic foot). The surface of the pad which contacts the tone hole rim may be maintained at a level of firmness which is required to maintain a flat padding surface which allows ease of installation and a repeatable seal. This lower density filler in the recess or recesses increases the conformability of the pad when it is engaged with the tone hole of the instrument so that it can deform if necessary in order to compensate for any variations in the shape of the rim of the tone hole thereby forming a good seal. At the same time that the pad is enabled to act in a conforming manner by the cushioning effect of the recesses. The base member could be of greater density than the mechanism in the recess, or less. For example, the base could be silicone and the medium air, or the base could be silicone and the medium water. If the medium is a fluid such as water the base should be generally elastomeric.

Figure 1:
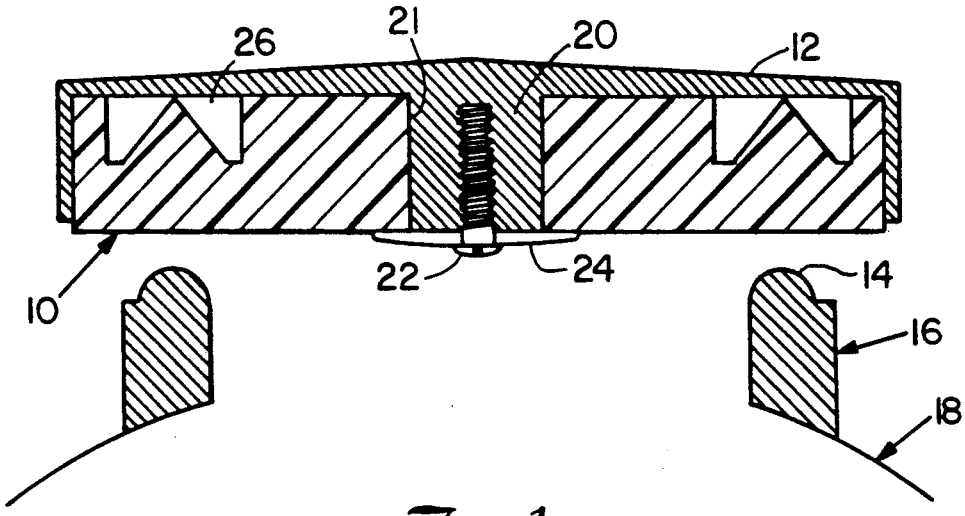
FIG. 1 is a side elevational cross-sectional schematic view of a pad according to this invention, installed in a cup suspended above a tone hole rim.
Figure 2:
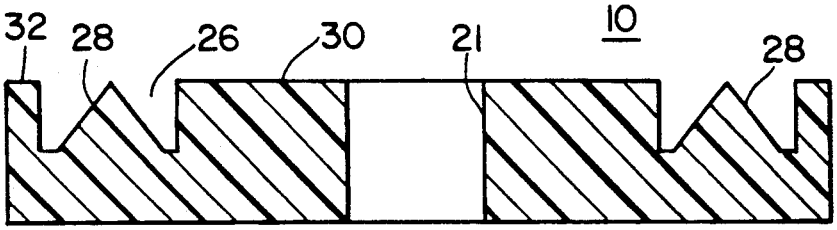
FIG. 2 is a side elevational sectional schematic view of the cushioned pad according to this invention taken along line 2—2 of FIG. 3.
Figure 3:
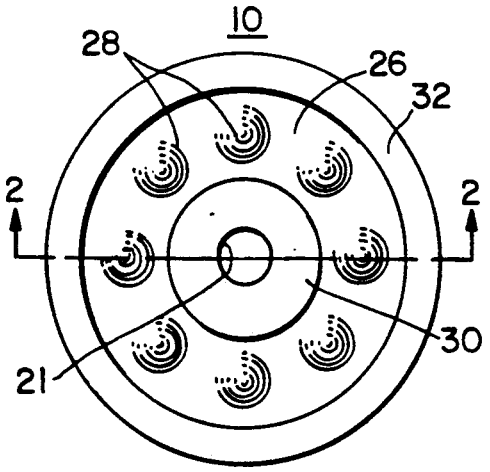
FIG. 3 is a schematic top plan view of the cushioned pad of FIG. 2.

There is shown in FIG. 1 a cushioned pad 10 mounted in a cup 12 approximate the rim 14 of the tone hole 16 of a musical instrument 18. Cushioned pad 10 may be held in place by means of a spud 20 which engages hole 21 and which receives a screw 22 that holds retaining washer 24. Cushioned pad 10, shown more clearly in FIG. 2, includes a recess 26. The recess in a preferred embodiment is simply filled with air and contains a plurality of discrete elements 28 which may be formed of the same material as the rest of pad 10 such as RBC 7125 with catalyst 720, whose density is 1.05. General Electric silicone rubber RV 6157 has a density of 0.98. As can be seen in FIG. 3, recess 26 is a continuous annular channel formed between internal or central mesa 30 and annular peripheral wall 32. While the discrete elements 28 are illustrated in FIG. 2 as plurality of discrete conical elements in a single row, this is not a limitation of the invention. The discrete element could be a single annular triangular cross-section element or there could be a number of rows of conical elements 28 in random or ordered pattern.

Pad cushion 10 may take a variety of forms. For example, pad cushion 10*a*, FIG. 4, includes a semi-circular recess 26*a* which may be filled with air and may contain a plurality of discrete hemispherically domed cylindrical elements 28*a* arranged in an annular path in annular recess 26*a* as more clearly shown in FIG. 5.

Figure 6:
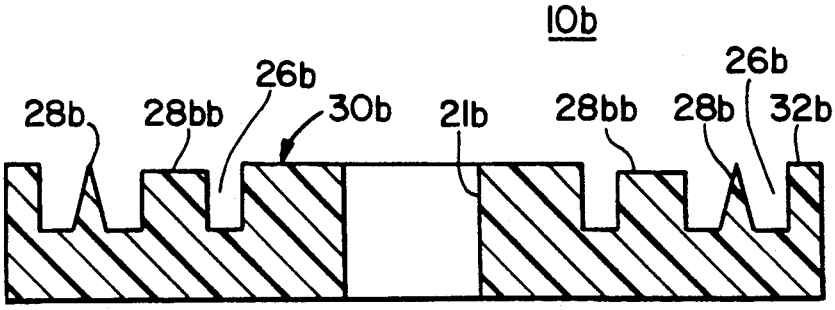
FIG. 6 is a view similar to FIG. 4, of yet another construction of the cushioned pad according to this invention having discrete elements of different heights taken along line 6—6 of FIG. 7.
Figure 7:
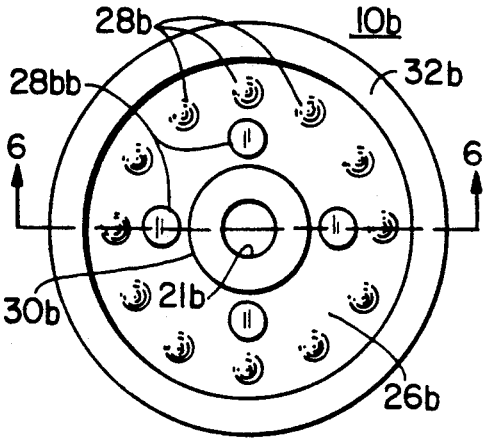
FIG. 7 is a top plan view of the cushioned pad of FIG. 6.

Pad cushion 10 may take the form of pad cushion 19*b*, FIG. 6, in which annular recess 26*b*, FIG. 7, includes plurality of high conical elements 28*b* which rise as high as the top wall 32*b* and a second plurality of cylindrical elements 28*bb* which rise to a level somewhat below the top of wall 32*b*. The thin pointed tops of the conical elements 28*b* are more compressible than the flat blunt top of the cylindrical elements 28*bb*, so as cushioned pad 10*b* is compressed by the action of the instrument, the cushion 10*b* compresses initially easily and then with more difficulty as elements 28*bb* are encountered.

Figure 9:
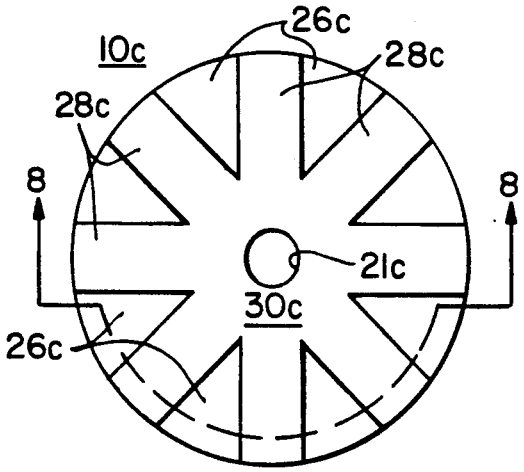
FIG. 9 is a top plan view of a cushioned pad of FIG. 8.
Figure 11:
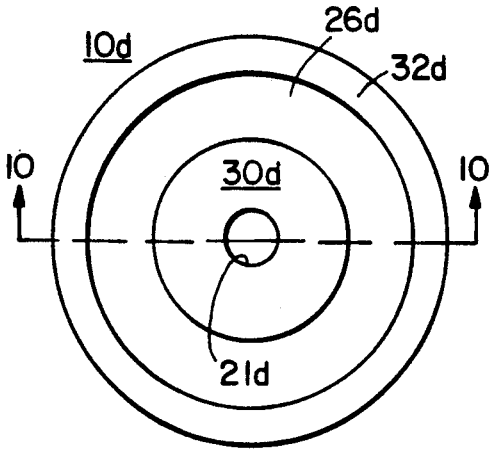
FIG. 11 is a top plan view of the cushion pad of FIG. 10.
Figure 8:
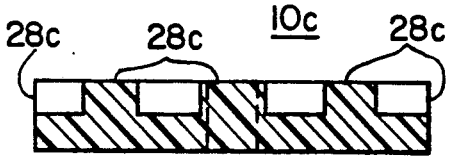
FIG. 8 is a view similar to FIG. 2 of yet another construction of a cushioned pad according to this invention taken along line 8—8 of FIG. 9.
Figure 10:
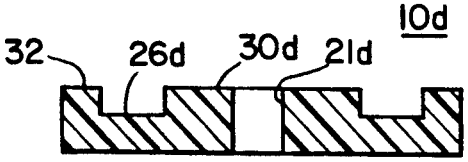
FIG. 10 is a view similar to FIG. 2 of yet another construction of a cushion pad according to this invention taken along line 10—10 of FIG. 11.

Cushioned pad 10*c* may take the form of a plurality of spokes 28*c*, FIGS. 8 and 9, extending from the central mesa 30*c* creating a plurality of recesses 26*c* between them or cushion pad 10*d*, FIGS. 10 and 11, may employ simply a recess such as annular recess 26*b* with no discrete elements in it to provide the cushioning effect.

Figure 12:
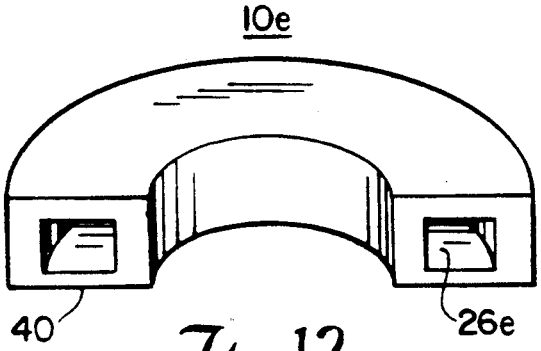
FIG. 12 is a partially broken away, three-dimensional view with portions in section of a cushioned pad according to this invention with the recess totally embedded in the pad.

Although thus far, the one or more recesses have been shown as open voids, this is not a necessary limitation of the invention, for as shown in FIG. 12 cushioned pad 10*e* may include an annular recess 26*e* which is totally contained and embedded within the pad and located closer to the surface 40 which contacts the tone hole rim. Recessed 26*e* may be filled with any suitable lower density material: water has been found to provide an excellent cushioning effect to permit cushion pad 10*e* to conform to the eccentricities of the tone hole rim.

Figure 4:
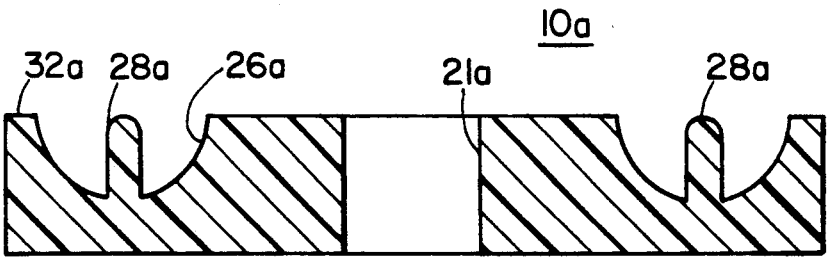
FIG. 4 is a view similar to FIG. 2 of an alternative construction of the cushioned pad according to this invention taken along line 4—4 of FIG. 5.
Figure 5:
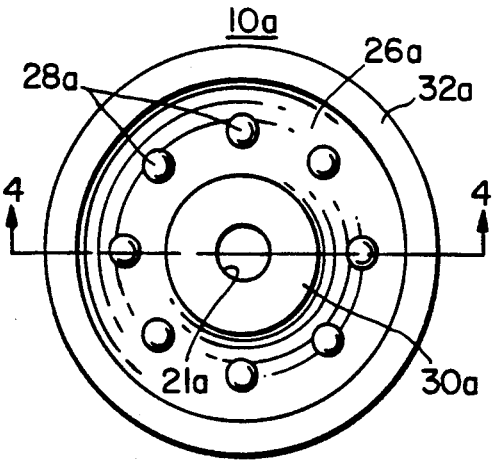
FIG. 5 is a schematic top plan view of the cushioned pad of FIG. 4.
Figure 13A:
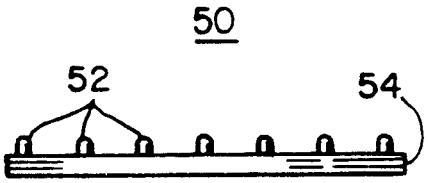
FIG. 13A is a side elevational view of a independent cushion according to this invention.
Figure 13B:
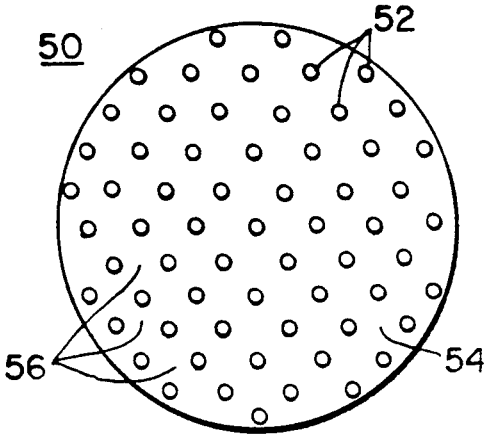
FIG. 13B is a top plan view of the cushion of FIG. 13A.

The various embodiments so far discussed have been referred to as cushioned pads wherein the pad function and the cushion function are provided in one integral unit but this is not a necessary limitation of the invention. The pad element which contacts the tone hole may be a separate member from the cushion member which provides the cushioning affect. For example, the constructions shown in FIGS. 2–11 may be all simply cushion members that must be combined with a pad member in order to provide a complete unit for installation in the cup of a musical instrument. FIG. 13*a* shows such a pad cushion 50 which includes a plurality of discrete salient members or nipples 52 which rise above a base member 54 to create voids or recesses 56. The random pattern of distribution of nipples 52 may be seen more clearly in the plan view of FIG. 13*b*. Cushion 50 may use nipples on this device such as shown in FIGS. 2–4 for creating recesses or voids.

Figure 15:
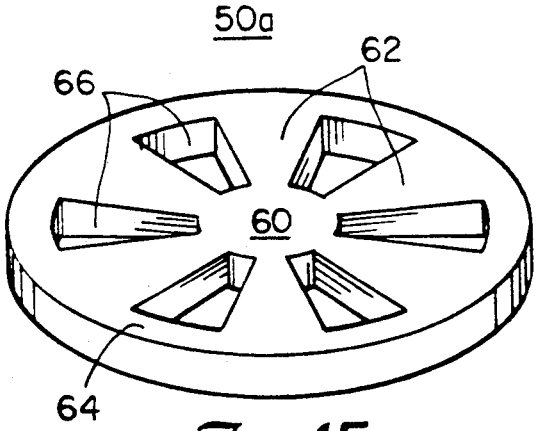
FIG. 15 is a three dimensional view of a cushion similar to that of FIG. 13 for use with a pad.
Figure 14:
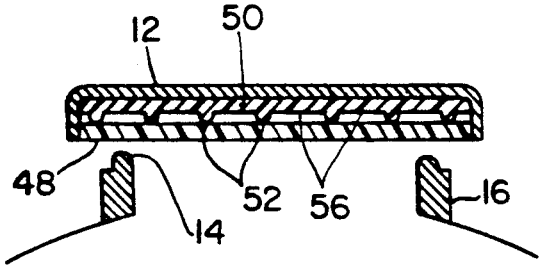
FIG. 14 is a side elevational view of the cushion of FIG. 13A and B assembled with a conventional pad according to this invention and installed in a cup adjacent to a tone hole.
Figure 16:
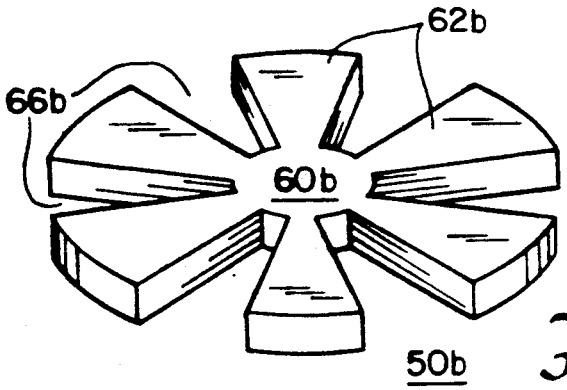
FIG. 16 is a view similar to FIG. 15 of an alternative form of cushion for use with pad according to this invention.

Pad cushion 50 is combined with a conventional pad 48, FIG. 14, and installed in cup 12 to cushion pad 48 as it encounters rim 14 of tone hole 16. The pad cushion 50 may take the form of a spoke wheel 50*a*, FIG. 15, which includes a hub 60 with a plurality of spokes 62 extending radially to rim 64 to create voids or recesses 66. Alternatively, the rim 64 may be eliminated to produce a pad cushion 59*b*, FIG. 16, which includes a plurality of radially extending spokes 62*b* emanating from hub 60*b* to create voids or recesses 66*b*. Just as the forms of the recesses and elements in FIGS. 2–11 illustrated with respect to a unitary cushioned pad construction can be employed as a separate pad cushion, the designs for the pad cushion shown in FIGS. 13, 15 and 16 may be employed in the integral cushioned pad units.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A cushioned pad, receivable by a cup, for engaging with the rim of a tone-hole of a musical instrument comprising:

a rigid valving surface portion for sealably contacting the rim of the tone hole;

a compressible portion of a density less than said rigid valving portion, receivable within the interior of the cup, in contact with said valving surface portion, and including at least one cavity; and a first plurality of discrete element disposed on said cavity.

2. A cushioned pad, receivable by a cup for engaging with the rim of a tone hole of a musical instrument comprising:

a rigid valving surface portion for sealably connecting the rim of the tone hole;

a compressible portion of a density less than said rigid valving surface portion, receivable within the cup, in contact with said valving surface portion, and including at least one cavity;

a first plurality of discrete elements disposed in said cavity; and a second plurality of discrete elements disposed in said cavity having a height less than the height of said first plurality of discrete elements.

3. An assembly receivable by a cup for a musical instrument tone hole comprising:

a tone hole pad having a bottom surface for engaging the tone hole and a top surface disposed within the cup; and a cushion for said tone hole pad receivable within the cup and in contact with said top surface of said pad including a hub and a plurality of spokes extending radially outward therefrom.

4. A cushioned pad, receivable by a cup, for engaging with the rim of a tone hole of a musical instrument comprising;

a valving surface portion, of a first density, for sealably contacting the rim of the tone hole; and a compressible portion, of a second density, receivable within the interior of the cup and in contact with said valving surface portion, including at least one cavity in communication with the interior of the cup for providing compliance in said valving surface portion and for damping noise generated by the contact of said valving surface portion with said tone hole rim.

5. The cushioned pad of claim 4 in which said first density is substantially greater than said second density.

6. The cushioned pad of claim 5 in which said valving surface portion is cork material.

7. A cushioned pad, receivable by a cup, for engaging with the rim of a tone hole of a musical instrument comprising:

a valving surface portion, of a first density, for sealably contacting the rim of the tone hole; and a compressible portion, of a second density, receivable within the interior of the cup and in contact with said valving surface portion, including at least one cavity in communication with the interior of the cup for providing compliance in said valving surface portion and for damping noise generated by the contact of said valving surface portion with said tone hole rim, said cavity including a first plurality of discrete elements rising upwards from the floor of said cavity within the interior of said cup.

8. The cushioned pad of claim 7 in which said discrete elements are conical.

9. The cushioned pad of claim 7 further including a second plurality of discrete elements each of which have a height less than the height of said first plurality of discrete elements for providing dual stages of compression of said compressible portion.

10. The cushioned pad of claim 7 in which said compressible portion is an acoustical damping material.

11. The cushioned pad of claim 7 in which said first plurality of discrete elements are of a third density.

12. The cushioned pad of claim 9 in which said second plurality of discrete elements are of a density different than the density of said first plurality of discrete elements.

13. A cushion for a musical instrument tone hole pad receivable within the interior of a cup comprising:

a bottom surface portion for contacting the pad;

a compressible portion of a density less than the pad including at least one cavity in communication with the interior of the cup;

a first plurality of discrete elements disposed in said cavity, the tops of which are in contact with the cup and the bases of which reside on the floor of said cavity;

a second plurality of discrete elements disposed in said cavity and having a height less than the height of said first plurality of discrete elements for providing dual stages of compression in said compressible portion.

14. The cushion of claim 13 in which said first plurality of discrete elements have a density different than the density of said compressible portion.

15. The cushion of claim 13 in which said first plurality of discrete elements have a density different than the density of said second plurality of discrete elements.

* * * * *